US009435303B2

(12) United States Patent
Yasuda et al.

(10) Patent No.: US 9,435,303 B2
(45) Date of Patent: Sep. 6, 2016

(54) SUPPORT STRUCTURE FOR FUEL INJECTION VALVE

(71) Applicant: KEIHIN CORPORATION, SHINJUKU-KU, TOKYO (JP)

(72) Inventors: Takahiro Yasuda, Tochigi (JP); Noriaki Sumisya, Tochigi (JP); Daisuke Kondo, Tochigi (JP); Kenichi Saito, Tochigi (JP)

(73) Assignee: Keihin Corporation, Tokyo (JP)

( * ) Notice: Subject to any disclaimer, the term of this patent is extended or adjusted under 35 U.S.C. 154(b) by 65 days.

(21) Appl. No.: 14/069,443

(22) Filed: Nov. 1, 2013

(65) Prior Publication Data

US 2014/0123952 A1 May 8, 2014

(30) Foreign Application Priority Data

Nov. 5, 2012 (JP) ..... 2012-243864

(51) Int. Cl.
*F02M 39/00* (2006.01)
*F02M 61/14* (2006.01)

(52) U.S. Cl.
CPC ..... *F02M 39/00* (2013.01); *F02M 61/14* (2013.01); *F02M 2200/85* (2013.01); *F02M 2200/856* (2013.01)

(58) Field of Classification Search
CPC .... F02M 39/00; F02M 61/14; F02M 61/145; F02M 69/045; F02M 69/046; F02M 2200/85
USPC ..... 123/470; 239/585.1, 584, 533.2
See application file for complete search history.

(56) References Cited

U.S. PATENT DOCUMENTS 4,993,390 A 2/1991 Ono et al.
5,058,554 A 10/1991 Takeda et al.

(Continued)

FOREIGN PATENT DOCUMENTS

CN 2651457 Y 10/2004
CN 102046958 A 5/2011

(Continued)

OTHER PUBLICATIONS

Official Communication dated Aug. 25, 2015 issued over the corresponding German Patent Application 10 2013 221 933.4.

(Continued)

*Primary Examiner* — Grant Moubry
(74) *Attorney, Agent, or Firm* — Carrier Blackman & Associates, P.C.; William D. Blackman; Joseph P. Carrier

(57) ABSTRACT

In a fuel injection valve support structure which can apply a substantially constant set load, the fuel injection valve has first and second load receiving portions, the first load receiving portion being supported on the engine, the second load receiving portion being supported on an elastic support member which receives a set load from a fuel supply cap. The elastic support member includes a base plate placed on the second load receiving portion, and an elastic piece curving rearward from one end toward the other end of the base plate, with an apex portion in pressure contact with the cap, the base plate has a portion overhanging from the second load receiving portion and supporting a tip end portion of the elastic piece. The overhang portion starts bending when a load the overhang portion receives from the cap through the elastic piece reaches or exceeds a predetermined value.

6 Claims, 5 Drawing Sheets

(56) References Cited

U.S. PATENT DOCUMENTS

| | | | | |
|---|---|---|---|---|
| 5,074,269 | A | 12/1991 | Herbon et al. | |
| 5,724,946 | A | 3/1998 | Franchitto | |
| 5,820,168 | A | 10/1998 | De Giacomoni | |
| 5,970,953 | A * | 10/1999 | Lorraine | F02M 69/465 123/456 |
| 6,148,797 | A | 11/2000 | Gmelin | |
| 6,199,538 | B1 | 3/2001 | Aota et al. | |
| 6,276,339 | B1 | 8/2001 | Shebert, Jr. et al. | |
| 6,481,420 | B1 | 11/2002 | Panasuk et al. | |
| 6,684,861 | B2 * | 2/2004 | Reiter | 123/470 |
| 7,104,257 | B2 * | 9/2006 | Kawamoto et al. | 123/470 |
| 7,210,462 | B2 * | 5/2007 | Scheffel et al. | 123/470 |
| 7,373,926 | B2 * | 5/2008 | Eckbauer et al. | 123/470 |
| 7,406,946 | B1 | 8/2008 | Watanabe et al. | |
| 7,540,273 | B2 * | 6/2009 | Scheffel et al. | 123/470 |
| 7,581,530 | B2 * | 9/2009 | Scheffel et al. | 123/470 |
| 7,802,559 | B2 * | 9/2010 | Furst et al. | 123/470 |
| 7,931,007 | B2 | 4/2011 | Fischer et al. | |
| 8,215,289 | B2 * | 7/2012 | Fischer et al. | 123/470 |
| 8,707,930 | B2 | 4/2014 | Bolz et al. | |
| 8,757,128 | B2 | 6/2014 | Fischer et al. | |
| 9,032,934 | B2 | 5/2015 | Nakamura et al. | |
| 9,109,563 | B2 | 8/2015 | Roseborsky et al. | |
| 9,115,679 | B2 | 8/2015 | Roseborsky et al. | |
| 9,212,641 | B2 | 12/2015 | Nakamura et al. | |
| 2008/0302336 | A1 | 12/2008 | Fuerst et al. | |
| 2009/0184512 | A1 | 7/2009 | Giorgetti et al. | |
| 2010/0012093 | A1 | 1/2010 | Pepperine et al. | |
| 2010/0300406 | A1 | 12/2010 | Harvey et al. | |
| 2012/0031997 | A1 | 2/2012 | Harvey et al. | |
| 2013/0220276 | A1 | 8/2013 | Nakamura et al. | |
| 2013/0220277 | A1 | 8/2013 | Nakamura et al. | |
| 2014/0123933 | A1 | 5/2014 | Okamoto et al. | |
| 2014/0123952 | A1 | 5/2014 | Yasuda et al. | |
| 2015/0013643 | A1 | 1/2015 | Serra et al. | |

FOREIGN PATENT DOCUMENTS

| | | | |
|---|---|---|---|
| CN | 102076955 | A | 5/2011 |
| CN | 102734027 | A | 10/2012 |
| DE | 102005013981 | A1 | 9/2006 |
| DE | 102005020380 | A1 | 11/2006 |
| DE | 10 2010 017725 | A1 | 1/2012 |
| EP | 1 892 408 | A1 | 2/2008 |
| EP | 2492489 | A1 * | 8/2012 |
| JP | 2001-511867 | A | 8/2001 |
| JP | 2004-245168 | A | 9/2004 |
| JP | 2007298066 | A | 11/2007 |
| JP | 2011-501020 | A | 1/2011 |
| JP | 2011099456 | A | 5/2011 |
| JP | 2011-196293 | A | 10/2011 |

OTHER PUBLICATIONS

Official Communication dated Sep. 1, 2015 issued over the corresponding CN Patent Application 201310537588.X of co-pending U.S. Appl. No. 14/069,796.

Official communication (Decision of Granting a Patent) issued to the corresponding Japanese patent application 2012-242534, of co-pending U.S. Appl. No. 14/057,144, dated May 18, 2016.

* cited by examiner

2

13
A,C
Db
D
4a
9
Da
4
18
16
16
15
S
17
20
12
5b
19
20
17
6,21
6,21
3
I
5a
8
11
2
10
E
Ec
2

SUPPORT STRUCTURE FOR FUEL INJECTION VALVE

BACKGROUND OF THE INVENTION

1. Field of the Invention

The present invention relates to an improvement of a support structure for a fuel injection valve in which a nozzle part in a front end section of a fuel injection valve is fitted in an injection-valve mounting hole in an engine, and a fuel supply cap of a fuel distribution tube supported on the engine is fitted on a fuel introducing part in a rear end section of the fuel injection valve, the fuel injection valve having a first load receiving portion and a second load receiving portion along an axial direction thereof, the first load receiving portion being supported on the engine, the second load receiving portion being supported on an elastic support member which receives a set load from the fuel supply cap.

2. Description of the Related Art

Such a support structure for a fuel injection valve is known as disclosed in Japanese Patent Application Laid-open No. 2004-245168.

SUMMARY OF THE INVENTION

In the above support structure for a fuel injection valve, the set load of the elastic support member supporting the fuel injection valve is determined by the amount of deformation of the elastic support member, that is, the amount by which the fuel supply cap is pressed against the elastic support member. However, the amount by which the fuel supply cap is pressed varies, due to the position at which the fuel supply cap is fixed to the engine, and manufacturing errors in portions of the engine that support the first load receiving portion, or the like. For this reason, it has heretofore been difficult to apply a constant set load to the elastic support member.

The present invention has been made in view of the above circumstance, and an object thereof is to provide a support structure for a fuel injection valve which can apply a substantially constant set load to an elastic support member even when the amount by which a fuel supply cap is pressed against the elastic support member varies.

In order to achieve the object, according to a first aspect of the present invention, there is provided a support structure for a fuel injection valve in which a nozzle part in a front end section of a fuel injection valve is fitted in an injection-valve mounting hole in an engine, and a fuel supply cap of a fuel distribution tube supported on the engine is fitted on a fuel introducing part in a rear end section of the fuel injection valve, the fuel injection valve having a first load receiving portion and a second load receiving portion along an axial direction thereof, the first load receiving portion being supported on the engine, the second load receiving portion being supported on an elastic support member which receives a set load from the fuel supply cap, wherein the elastic support member includes a base plate placed on the second load receiving portion, and an elastic piece curving rearward from one end of the base plate and extending toward the other end of the base plate, and having an apex portion thereof in pressure contact with a front end surface of the fuel supply cap, the base plate has an overhang portion overhanging from the second load receiving portion and supporting a tip end portion of the elastic piece, and the overhang portion starts bending when a load the overhang portion receives from the fuel supply cap through the elastic piece reaches or exceeds a predetermined value.

According to the first aspect of the present invention, the elastic support member includes the base plate placed on the second load receiving portion, and the elastic piece curving rearward from the one end of the base plate and extending toward the other end of the base plate, and having the apex portion thereof in pressure contact with the front end surface of the fuel supply cap; the base plate has the overhang portion overhanging from the second load receiving portion and supporting the tip end portion of the elastic piece; and the overhang portion starts bending when the load the overhang portion receives from the fuel supply cap through the elastic piece reaches or exceeds the predetermined value. Thus, when the fuel supply cap is fixed to its preset position, the load of the elastic piece of the elastic support member increases according to its deformation by pressing force from the fuel supply cap. As that load reaches or exceeds the predetermined value, the overhang portion of the base plate starts bending, so that the increase in the load to be applied to the elastic piece slows down. Accordingly, by causing the overhang portion to bend already when the fuel supply cap is fixed to its preset position, a substantially constant set load can be applied to the elastic support member even if the amount by which the fuel supply cap is pressed against the elastic support member may vary, due to the position at which the fuel supply cap is fixed, and manufacturing errors in portions which support the first load receiving portion of the fuel injection valve, or the like. Thereby, the fuel injection valve can be held always in a stably supported state.

According to a second aspect of the present invention, in addition to the first aspect, in the overhang portion, a narrow portion is formed near the second load receiving portion so that the bending occurs at the narrow portion.

According to the second aspect of the present invention, in the overhang portion, the narrow portion is formed near the second load receiving portion, and the bending occurs at the narrow portion. Thereby, the state of bending of the overhang portion is made constant, so that the fuel injection valve can be held always in a more stably supported state.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be described with reference to the accompanying drawings.

Figure 1:
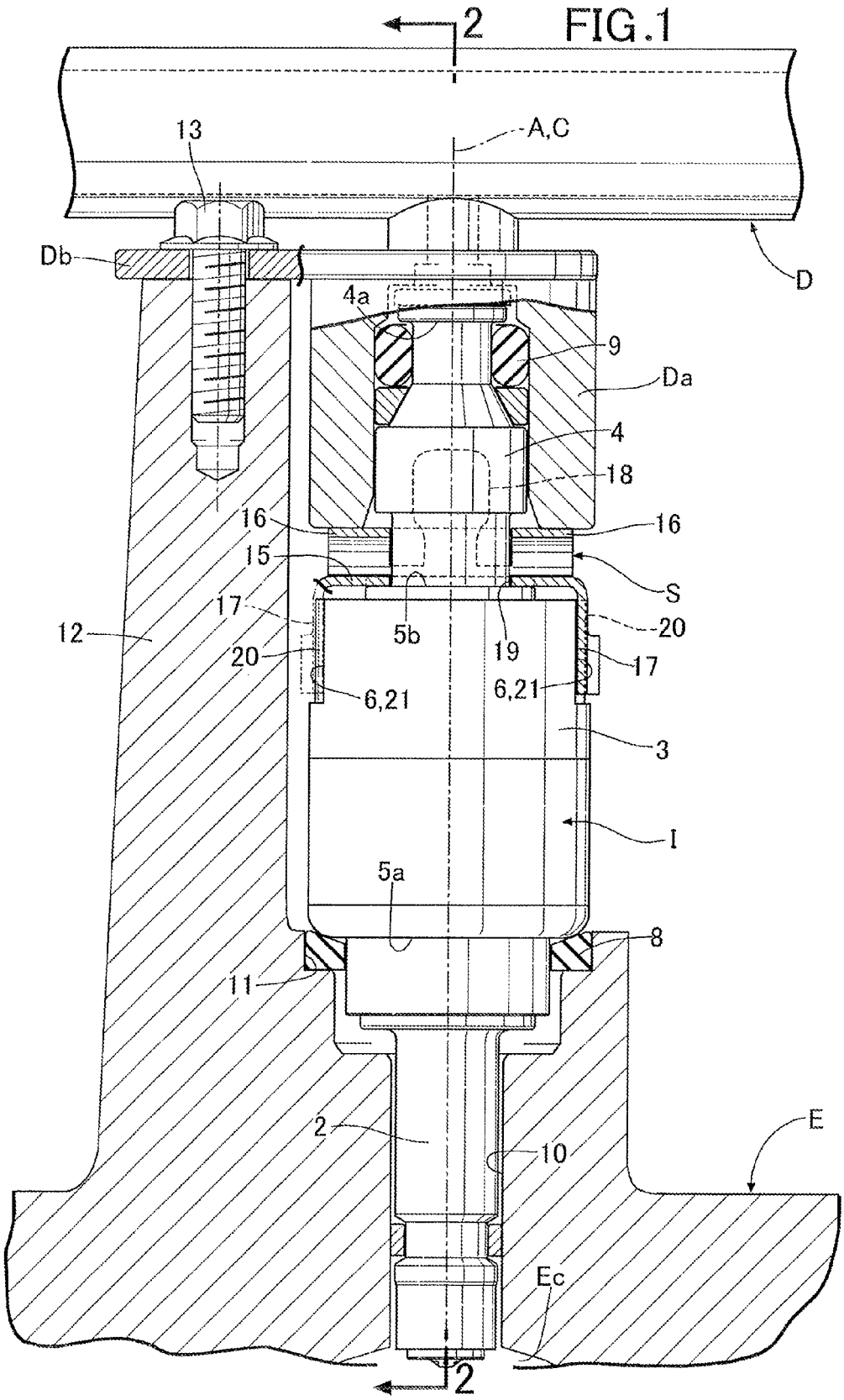
FIG. 1 is a partial longitudinal sectional elevation view showing a support structure for a fuel injection valve in an engine according to an embodiment of the present invention.
Figure 2:
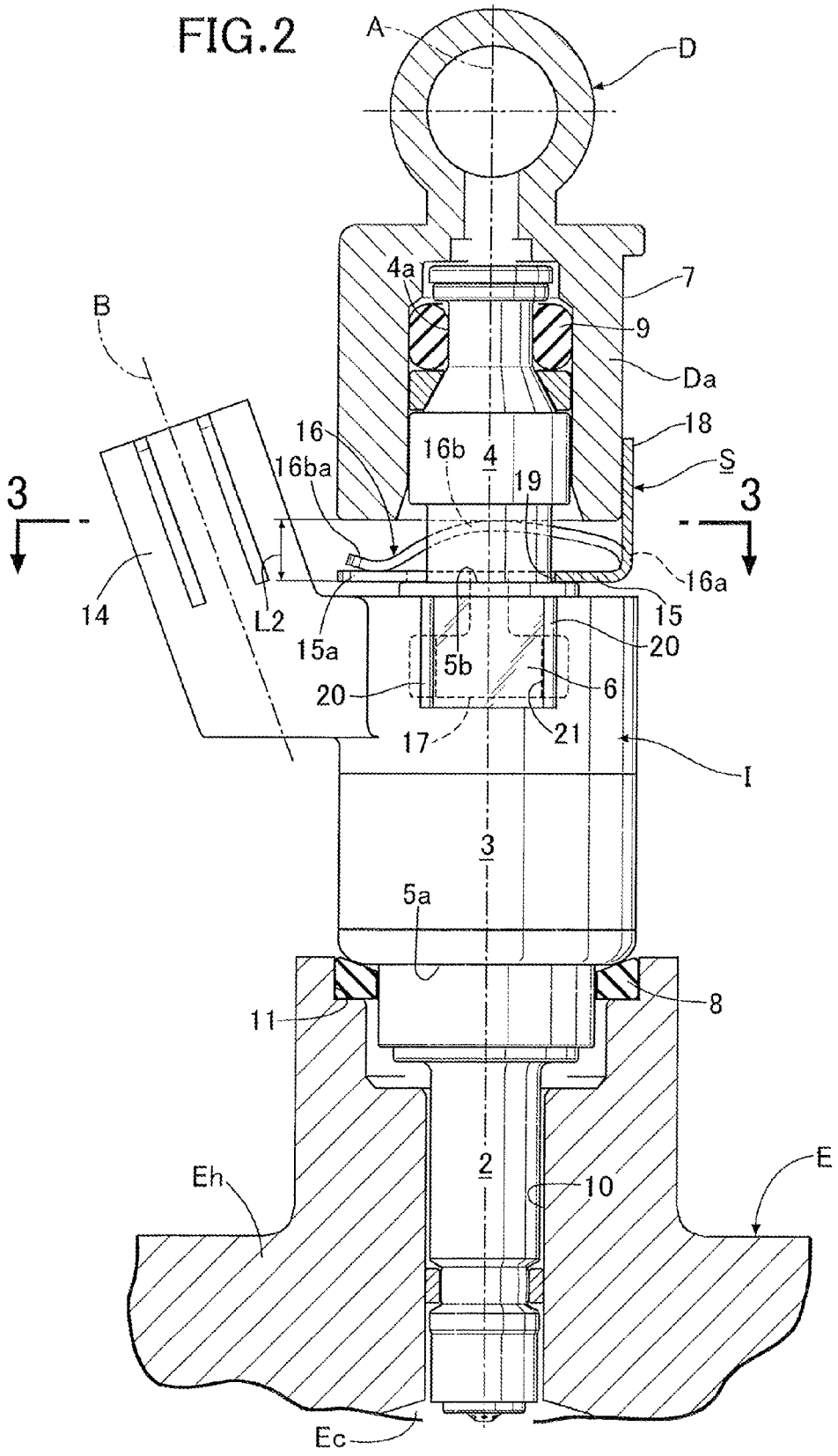
FIG. 2 is a sectional view taken along line 2-2 in FIG. 1.

First, referring to FIGS. 1 and 2, multiple fuel injection valves I each of which is capable of injecting fuel into a combustion chamber Ec in a cylinder, and a fuel distribution tube D through which fuel is distributed to the fuel injection valves I are attached to a cylinder head Eh of an engine E. Moreover, an elastic support member S is interposed between each fuel injection valve I and the fuel distribution tube D so as to prevent displacement of the fuel injection valve I either in an axial direction or about a center axis A of the fuel injection valve I. This structure will be described below in detail.

Each fuel injection valve I includes a cylindrical nozzle part 2, an electromagnetic coil part 3, and a fuel introducing part 4 aligned coaxially with each other in this order from a front end to a rear end of each fuel injection valve I. When the electromagnetic coil part 3 is energized, a valve inside the nozzle part 2 is opened, so that fuel introduced in the fuel introducing part 4 from the fuel distribution tube D is injected directly into the combustion chamber Ec from the nozzle part 2. Note that in the present invention, the nozzle part 2 side will be referred to as a front side, and the fuel introducing part 4 side will be referred to as a rear side.

The outer diameter of this fuel injection valve I becomes larger in the order of the nozzle part 2, the fuel introducing part 4, and the electromagnetic coil part 3, and thus the electromagnetic coil part 3 has a maximum outer diameter. A coupler 14 for supplying power is integrally provided on and protruding from one side surface of the electromagnetic coil part 3.

An annular first load receiving portion 5*a* is formed on a front end surface of the electromagnetic coil part 3, and an annular cushion member 8 is mounted on an outer periphery of the nozzle part 2. Moreover, an annular second load receiving portion 5*b* is formed on a rear end surface of the electromagnetic coil part 3. Further, an O-ring 9 is mounted in a seal groove 4*a* in an outer periphery of the fuel introducing part 4.

Moreover, a pair of flat first contact surfaces 6 are formed in cutout shapes on an outer peripheral surface of the electromagnetic coil part 3 in such a way as to be opposite to each other with a plane C therebetween, the plane C including the center axis A of the fuel injection valve I and a center line B of the coupler 14. A pair of restricting protrusions 20 extending in the axial direction of the fuel injection valve I and disposed side by side with a gap therebetween are formed on each first contact surface 6. Each pair of restricting protrusions 20 define a positioning groove 21 extending in an up-down direction, on the first contact surface 6.

Meanwhile, the cylinder head Eh has: injection-valve mounting holes 10 with inner ends thereof opening at ceiling surfaces of the combustion chambers Ec, respectively; and annular concave portions 11 surrounding outer opening ends of the injection-valve mounting holes 10, respectively. The nozzle part 2 of each fuel injection valve I is fitted in each injection-valve mounting hole 10, and the cushion member 8 is housed in each of the concave portions 11. Thus, the first load receiving portion 5*a* of each fuel injection valve I is supported on the cylinder head Eh with the cushion member 8 therebetween.

The fuel distribution tube D is disposed along the direction in which the multiple cylinders of the engine E are aligned, and fuel is fed under pressure from one end of the fuel distribution tube D by means of a fuel pump not shown. The fuel distribution tube D is provided with multiple fuel supply caps Da protruding from one side surface thereof and disposed along a direction in which the multiple cylinders are aligned. Each fuel supply cap Da is fitted on the outer periphery of the fuel introducing part 4 of the corresponding fuel injection valve I. In this fitted state, the O-ring 9 is in tight contact with an inner peripheral surface of the fuel supply cap Da. A flat second contact surface 7 parallel to the center axis A of the fuel injection valve I is formed on an outer side surface of the fuel supply cap Da. A bracket Db is fixedly provided to a base portion of the fuel supply cap Da. This bracket Db is fixed with a bolt 13 to a support column 12 standing upright on an upper surface of the cylinder head Eh.

Figure 3:
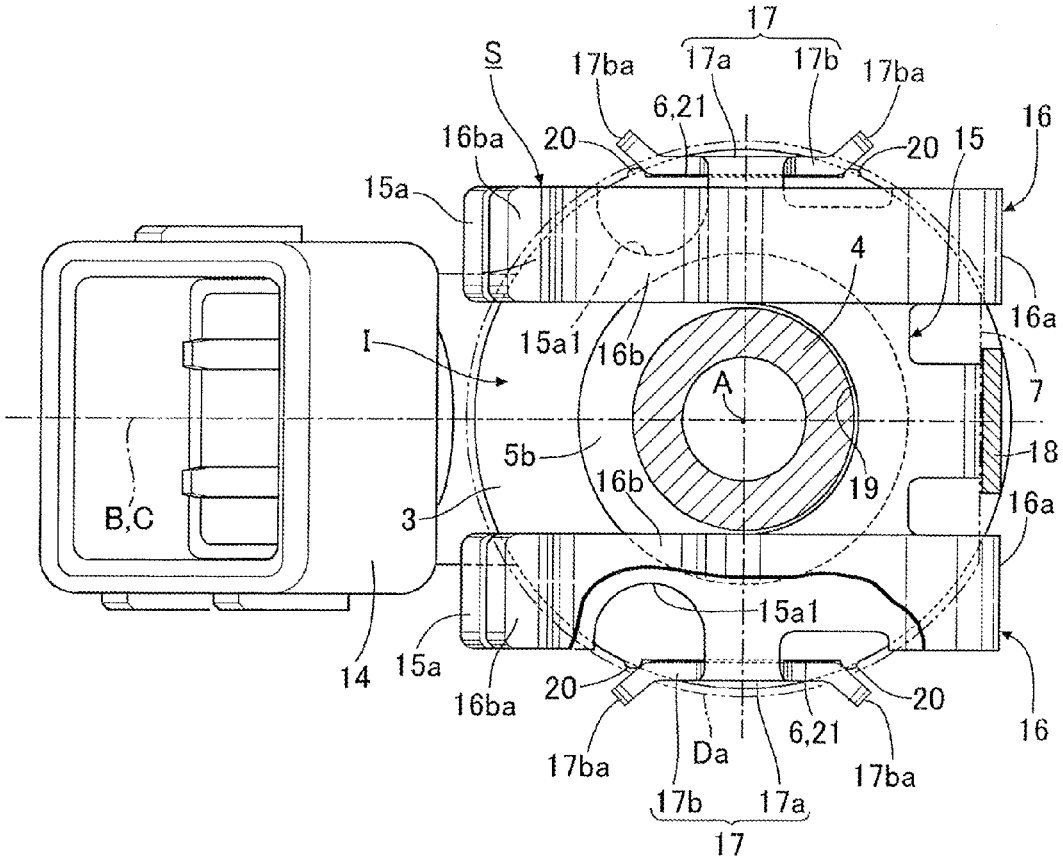
FIG. 3 is a sectional view taken along line 3-3 in FIG. 2.
Figure 4:
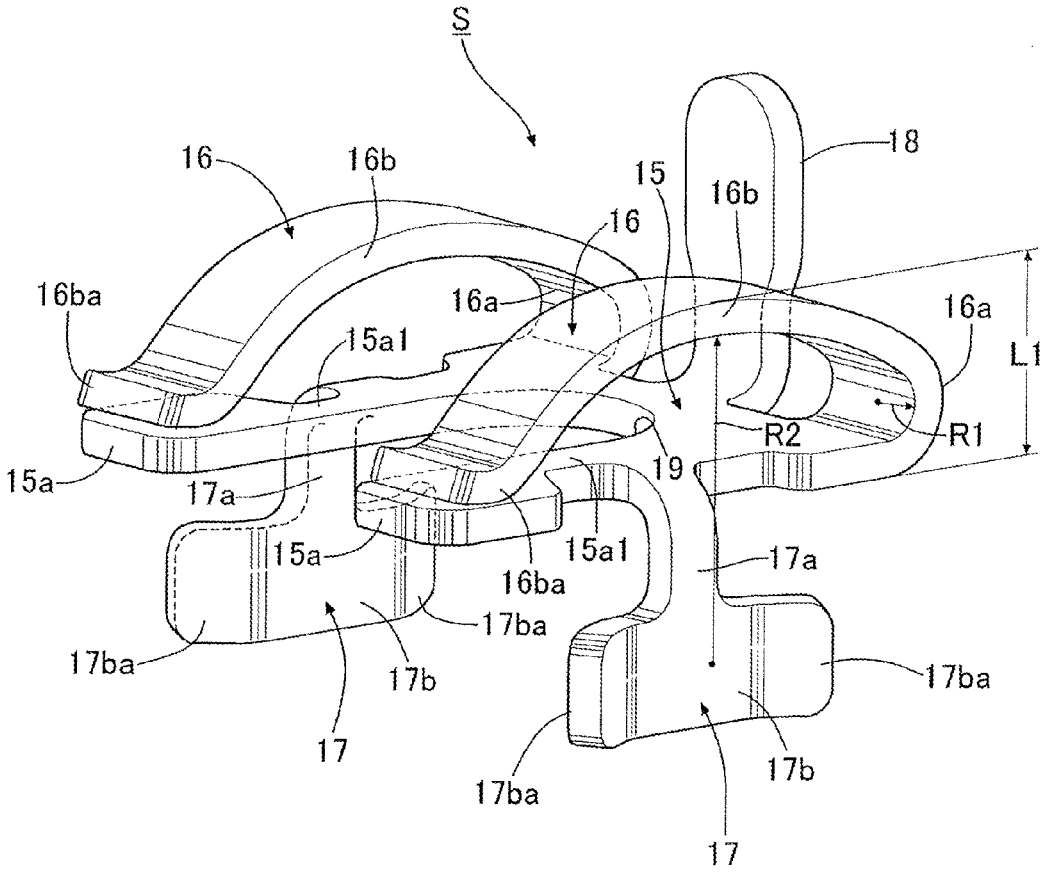
FIG. 4 is a perspective view of only an elastic support member in FIGS. 1 to 3.

As shown in FIGS. 2 to 4, the elastic support member S is obtained by pressing a spring steel sheet, and includes a base plate 15, a pair of elastic pieces 16, a pair of rotation locking pieces 17, and a positioning piece 18.

The base plate 15 is designed to be placed on top of the second load receiving portion 5*b*, and has a U-shaped cutout 19 in a center portion thereof through which the fuel introducing part 4 of the fuel injection valve I can be received. Overhang portions 15*a* which overhang from the second load receiving portion 5*b* are provided at an end portion of the base plate 15 on an opening side of the cutout 19. Moreover, in each overhang portion 15*a*, a narrow portion 15*a*1 with a reduced width is formed near the second load receiving portion 5*b*.

The pair of elastic pieces 16 are molded in such a way as to be integrally joined to one end of the base plate 15 on an opposite side from the U-shaped cutout 19. The elastic pieces 16 are capable of elastically coming into pressure contact with a front end surface of the fuel supply cap Da. These two elastic pieces 16 are disposed with a gap therebetween through which the fuel introducing part 4 of the fuel injection valve I can be received.

Each elastic piece 16 includes: a first elastic portion 16*a* curving upward in a sideways U-shape from the one end of the base plate 15; and a second elastic portion 16*b* extending from this first elastic portion 16*a* toward the other end of the base plate 15 while curving upward, and having a tip end portion 16*ba* in contact with an upper surface of a tip end portion of one of the overhang portions 15*a*. An apex portion of the second elastic portion 16*b* comes into pressure contact with the front end surface of the fuel supply cap Da. A curvature radius R2 of the second elastic portion 16*b* is set sufficiently larger than a curvature radius R1 of the first elastic portion 16*a* (see FIG. 4).

Moreover, in a free state of the elastic piece 16, a distance L1 from the apex of the second elastic portion 16*b* to a lower surface of the base plate 15 (see FIG. 4) is set larger than a distance L2 from the second load receiving portion 5*b* to the front end surface of the fuel supply cap Da (see FIG. 2).

Further, the overhang portion 15*a* starts bending forward at the narrow portion 15*a*1 upon receipt of a forward load of a predetermined value or larger from the elastic piece 16 side.

The tip end portion 16*ba* of the second elastic portion 16*b* is capable of sliding on an upper surface of the overhang portion 15*a* during the bending of the first and second elastic portions 16*a*, 16*b*. The tip end portion 16*ba* is formed in a shape curling in a direction away from the base plate 15, i.e. upward so as to make the sliding movement smooth.

The pair of rotation locking pieces 17 are integrally joined to opposite outside surfaces of the base plate 15, respectively. Each rotation locking piece 17 is formed in an inverted T-shape with a vertical portion 17*a* curving and extending downward from the outside surface of the base plate 15, and a horizontal portion 17*b* extending from a lower end of this vertical portion 17*a* along the U-shaped cutout 19. The pair of rotation locking pieces 17 are capable of clamping the electromagnetic coil part 3 by bringing their horizontal portions 17*b* into engagement with the positioning grooves 21 on the first contact surfaces 6, respectively. To perform this clamping in an elastic manner, a root of each vertical portion 17*a* is given elasticity that biases the horizontal portion 17*b* inward. Moreover, opposite end portions 17*ba* of the horizontal portion 17*b* are formed to curl outward. Thus, the horizontal portion 17*b* can be smoothly moved over the restricting protrusions 20 on opposite sides of the positioning groove 21 so as to be engaged with the positioning groove 21.

Further, the positioning piece 18 standing upward vertically from between the pair of elastic pieces 16 is integrally joined to the one end of the base plate 15. This positioning piece 18 is capable of coming into contact with the second contact surface 7 of the fuel supply cap Da.

Next, operations of this embodiment will be described.

To attach each fuel injection valve I to the engine E, firstly, the elastic support member S is held with an opening of the U-shaped cutout 19 in the base plate 15 facing the fuel injection valve I, and is mounted to the fuel injection valve I from the opposite side from the coupler 14, so that the base plate 15 is set on the second load receiving portion 5*b*, and the rotation locking pieces 17 are elastically engaged with the positioning grooves 21 on the first contact surfaces 6. In this way, each rotation locking piece 17 is prevented from tilting within the positioning groove 21 by the restricting protrusions 20 on the opposite sides of the positioning groove 21. As a result, an assembly is formed in which an attached posture of the elastic support member S to the fuel injection valve I is stable.

Thereafter, the nozzle part 2 of the fuel injection valve I thus assembled is inserted into each injection-valve mounting hole 10 in the cylinder head Eh, so that the cushion member 8 in tight contact with the first load receiving portion 5*a* of the electromagnetic coil part 3 is housed in the concave portion 11. Then, each fuel supply cap Da of the fuel distribution tube D is fitted onto the outer periphery of the fuel introducing part 4 of the fuel injection valve I, and the apex portion of each elastic piece 16 of the elastic support member S is pressed with the front end surface of the fuel supply cap Da to apply a set load (compressive load) thereto. In addition, the bracket Db of the fuel supply cap Da is fastened to the support column 12 of the cylinder head Eh with the bolt 13, so that the distance from the apex of each second elastic portion 16*b* to the lower surface of the base plate 15 is reduced from the distance L1 (FIG. 4) to the distance L2 (FIG. 2).

Upon receipt of the set load at the first and second load receiving portions 5*a*, 5*b*, the fuel injection valve I is elastically clamped between the cylinder head Eh and the elastic support member S, and also the positioning piece 18 is brought into contact with the second contact surface 7 of the fuel supply cap Da.

Here, as mentioned earlier, each rotation locking piece 17 has been prevented from tilting within the positioning groove 21 by the restricting protrusions 20 on the opposite sides of the positioning groove 21, and has been held in proper engagement with the positioning groove 21. Therefore, the positional relation between the fuel supply cap Da fitted on the fuel introducing part 4 and the elastic support member S is maintained constant. Accordingly, the pressing of the fuel supply cap Da against the elastic support member S can be performed accurately.

Meanwhile, each positioning groove 21 is defined between the pair of restricting protrusions 20 protruding from the corresponding first contact surface 6 and arranged thereon side by side with a gap in between. Thus, the positioning groove 21 can be formed on the first contact surface 6 without having to reduce a thickness of a sidewall of the electromagnetic coil part 3 corresponding to the first contact surface 6.

Figure 5:
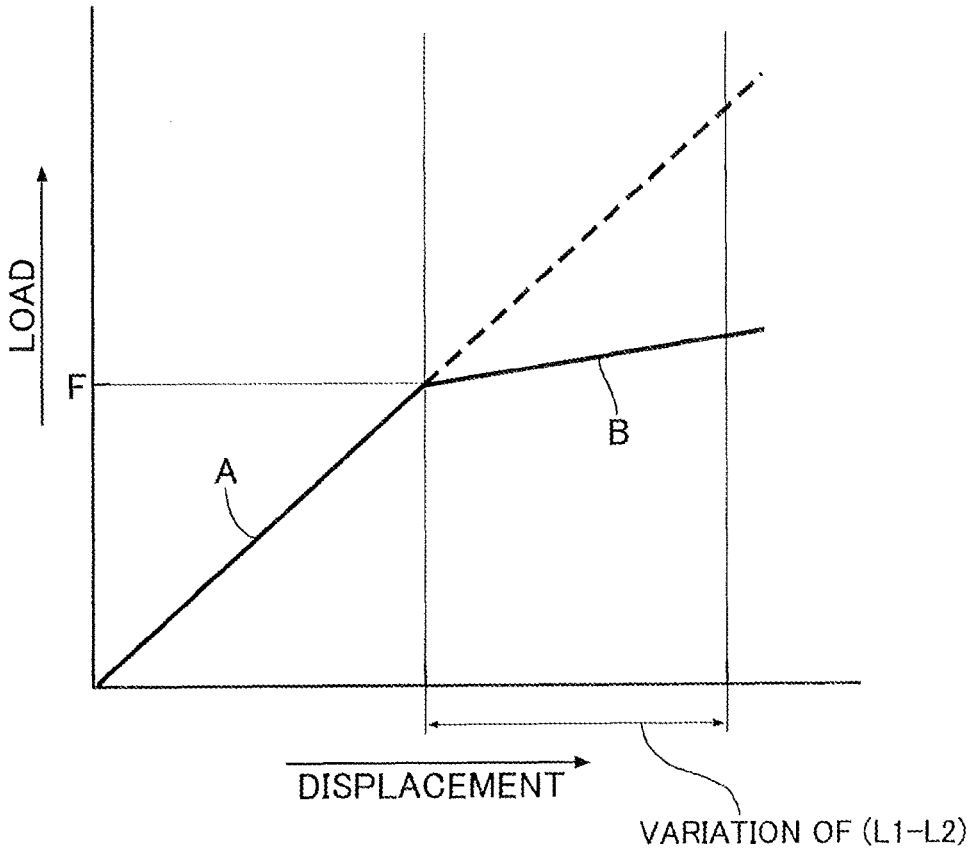
FIG. 5 is a diagram of spring characteristics of the elastic support member.

As shown by line A in FIG. 5, the elastic support member S is such that, the load of each elastic piece 16 increases according to its deformation by pressing force from the fuel supply cap Da, and that load is transmitted from a tip end portion 16*ba* of the elastic piece 16 to the overhang portion 15*a*. Then, as the load reaches or exceeds a predetermined value F (FIG. 5), the overhang portion 15*a*, particularly the narrow portion 15*a*1 of the base plate 15 starts bending, so that a tip end portion of the overhang portion 15*a* descends forward together with the tip end portion 16*ba* of the elastic piece 16. Consequently, an increase in the load to be applied to the elastic piece 16 slows down as shown by line B in FIG. 5. Accordingly, by causing the overhang portion 15*a* to bend already when the fuel supply cap Da is fixed to its preset position, that is, when the bracket Db is fastened to the support column 12, a substantially constant set load can be applied to the elastic support member S even if the amount by which the fuel supply cap Da is pressed against the elastic support member S may slightly vary, due to the position at which the fuel supply cap Da is fixed, and manufacturing errors in portions which support the first load receiving portion 5*a* of the fuel injection valve I, or the like. Thereby, the fuel injection valve I can be held always in a stably supported state.

Moreover, each elastic piece 16 includes: the first elastic portion 16*a* having the small curvature radius R1 and joined to one end portion of the base plate 15; and the second elastic portion 16*b* having the large curvature radius R2 and extending from the first elastic portion 16*a* to bring the tip end portion 16*ba* into slidable contact with the upper surface of the other end portion of the base plate 15. This allows the second elastic portion 16*b* to be supported on the base plate 15 at both ends via the tip end portion 16*ba* and the first elastic portion 16*a*. Thus, stress produced in each elastic piece 16 when the elastic support member S is set is distributed to the first and second elastic portions 16*a*, 16*b*, thereby making it possible to alleviate stress concentration that is likely to occur particularly in the first elastic portion 16*a* having the small curvature radius R1. Accordingly, it is possible to maintain the predetermined set load of the elastic piece 16 for a long period of time and stabilize the support of the fuel injection valve I.

Moreover, if by any chance the first elastic portion 16*a* with the small curvature radius R1 undergoes plastic deformation, the biasing function of the elastic piece 16 against the fuel supply cap Da can be maintained by an elastic force of the second elastic portion 16*b* supported at both ends, thereby causing no problem in supporting the fuel injection valve I.

Moreover, since the curvature radius R2 of the second elastic portion 16*b* is set larger than the curvature radius R1 of the first elastic portion 16*a*, a height of the elastic piece 16 is minimized. Accordingly, the elastic support member S can be easily mounted into a narrow space between the second load receiving portion 5*b* and the fuel supply cap Da.

Although an embodiment of the present invention has been described hereinabove, the present invention is not limited thereto, and various design changes can be made without departing from the gist of the present invention. For example, the positioning groove 21 may be defined on only one of the pair of first contact surfaces 6. Moreover, the positioning groove 21 may be formed by digging the first contact surface 6. Furthermore, the present invention may be applied to a structure in which each fuel injection valve I is attached to an intake system of an engine.

What is claimed is:

1. A support structure for a fuel injection valve in which a nozzle part in a front end section of the fuel injection valve is fitted in an injection-valve mounting hole in an engine, and a fuel supply cap of a fuel distribution tube supported on the engine is fitted on a fuel introducing part in a rear end section of the fuel injection valve, the fuel injection valve having a first load receiving portion and a second load receiving portion along an axial direction thereof, the first load receiving portion being supported on the engine, the second load receiving portion being supported on an elastic support member which receives a set load from the fuel supply cap, wherein the elastic support member includes a base plate placed on the second load receiving portion, and an elastic piece curving rearward from one end of the base plate and extending toward an opposite end of the base plate, and having an apex portion thereof in pressure contact with a front end surface of the fuel supply cap, the base plate has an overhang portion overhanging from the second load receiving portion and supporting a tip end portion of the elastic piece, the support structure configured such that the overhang portion is always kept in abutment against the tip end portion of the elastic piece, and the overhang portion is configured to start bending when a load the overhang portion receives from the fuel supply cap through the tip end portion of the elastic piece reaches or exceeds a predetermined value.

2. The support structure for a fuel injection valve according to claim 1, wherein in the overhang portion, a narrow portion is formed near the second load receiving portion so that the bending occurs at the narrow portion.

3. A support structure comprising an elastic support member for supporting a fuel injection valve on an engine, in which a nozzle part in a front end section of the fuel injection valve is fitted in an injection-valve mounting hole in the engine, and a fuel supply cap of a fuel distribution tube supported on the engine is fitted on a fuel introducing part in a rear end section of the fuel injection valve, the fuel injection valve having a first load receiving portion and a second load receiving portion along an axial direction thereof, the first load receiving portion being supported on the engine, and the second load receiving portion being supported on the elastic support member which receives a load from the fuel supply cap, wherein:

the elastic support member includes a base plate configured to be placed on the second load receiving portion, and an elastic piece curving rearward from one end of the base plate and extending toward another end of the base plate, and having an apex portion thereof in pressure contact with a front end surface of the fuel supply cap, the base plate has an overhang portion overhanging from the second load receiving portion, the overhang portion abuttingly contacting and supporting a tip end portion of the elastic piece, the support structure configured such that the overhang portion is always kept in abutment against the tip end portion of the elastic piece, and a part of the base plate proximate the overhang portion is configured to start bending when a load the overhang portion receives from the fuel supply cap, through the elastic piece, reaches or exceeds a predetermined value.

4. The support structure for the fuel injection valve according to claim 3, wherein in the part of the base plate proximate the overhang portion, a narrow portion is formed near the second load receiving portion, the narrow portion being narrower than the overhang portion of the base plate so that the bending occurs at the narrow portion.

5. The support structure for the fuel injection valve according to claim 3, wherein the elastic support member further comprises a positioning piece integrally attached to and extending rearwardly from the base plate for contacting a side portion of the fuel supply cap.

6. The support structure for the fuel injection valve according to claim 3, wherein the elastic support member further comprises a pair of rotation locking pieces for engaging opposite sides of the fuel injection valve, the rotation locking pieces extending forwardly from opposite sides of the base plate.

* * * * *